United States Patent [19]

Brown et al.

[11] 4,002,384

[45] Jan. 11, 1977

[54] COMPACT REFRIGERATOR COMBINED WITH TOP STORAGE CONTAINER

[75] Inventors: Richard C. Brown, Dayton, Ohio; Stuart B. Shuster, Birmingham, Mich.

[73] Assignee: General Motors Corporation, Detroit, Mich.

[22] Filed: Sept. 4, 1975

[21] Appl. No.: 610,140

[52] U.S. Cl. ..... 312/284; 312/246; 312/111; 62/258

[51] Int. Cl.[2] ..... A47F 5/08; A47B 47/00

[58] Field of Search ..... 312/111, 196, 236, 237, 312/284, 282, 313; 62/258, 377, 89

[56] References Cited

UNITED STATES PATENTS

| | | | |
|---|---|---|---|
| 2,118,735 | 5/1938 | Money | 312/313 |
| 2,942,924 | 6/1960 | Stangert | 312/196 |
| 3,353,888 | 11/1967 | Pritelli, Jr. | 312/111 |
| 3,379,482 | 4/1968 | Baggott | 312/111 |
| 3,519,319 | 7/1970 | Taylor | 312/246 |
| 3,734,588 | 5/1973 | Ellis | 312/246 |

*Primary Examiner*—Casmir A. Nunberg
*Attorney, Agent, or Firm*—Edward P. Barthel

[57] ABSTRACT

A compact refrigerator cabinet has a top storage container removably retained on its upper wall by means of a U-shaped top trim frame which extends along the front and side edges of the cabinet providing opposed trackways which normally retain a top panel. Flange means are provided on the underside of the container base which are slidably received in the trackways to provide a composite structure. The container has a generally half-round configuration including a concavo-convex top wall extending through a predetermined obtuse angle to define a front access opening. The base wall has a transverse shoulder formed by a notched portion extending inwardly from its front edge and a closure member pivotally supported adjacent the shoulder whereby the closure may be pivoted downwardly from an upstanding overcenter position closing the access opening to a horizontal position substantially flush with the cabinet base wall.

3 Claims, 5 Drawing Figures

COMPACT REFRIGERATOR COMBINED WITH TOP STORAGE CONTAINER

This invention relates to refrigerator cabinets and more particularly to a compact refrigerator cabinet combined with a removably mounted storage and service container on its top wall.

In carrying out the invention there is provided a compact domestic refrigerator wherein components which cooperate to support the refrigerator removable top panel are utilized in the mounting of a removable container or a generally half-round storage container having a top concavo-convex wall of single curvature with rear and side walls substantially flush with the refrigerator cabinet walls such that the container has the appearance of being integral with the refrigerator cabinet whereby upon assembly therewith the combined appliance resembles a mail box structure or the like.

It is therefore an object of the present invention to provide a container removably supported on the upper surface of a compact domestic refrigerator cabinet having securing means utilizing components of the cabinet U-shaped top trim frame such that the container can be readily installed by the customer upon removal of the refrigerator cabinet top panel by slidably inserting flange runners on the undersurface of the container base within the opposed trim frame side trackways such that the container is substantially flush with the side and rear walls of the refrigerator cabinet to provide a unitary appearing composite appliance.

It is still another object of the present invention to provide an improved combined compact refrigerator and storage container which is removably retained on the upper wall of the refrigerator cabinet, with the container having a generally half-round configuration in the form of an inverted U-sectioned box with a top concavo-convex wall of single curvature including a lateral rear wall portion extending substantially tangentially downwardly from the rearward terminal of the concavo-convex wall, so as to be substantially flush with the refrigerator cabinet rear wall; the U-sectioned container having a base wall coextensive with the cabinet upper surface and the concavo-convex wall extending through a predetermined arc of about 105° to define a front access opening, wherein the base having a transverse shoulder formed by a notched portion extending inwardly from the base front edge, and a closure pivotally supported adjacent the shoulder whereby the closure opens downwardly from an upstanding overcenter position closing the access opening to a horizontally disposed position with its upper surface positioned substantially flush with the upper surface of the base wall providing a smooth service or working area for conditions and requirements of the refrigerator cabinet and container.

Further objects and advantages of the present invention will be apparent from the following description, reference being made to the accompanying drawings wherein a preferred embodiment of the present invention is clearly shown:

Figure 1:
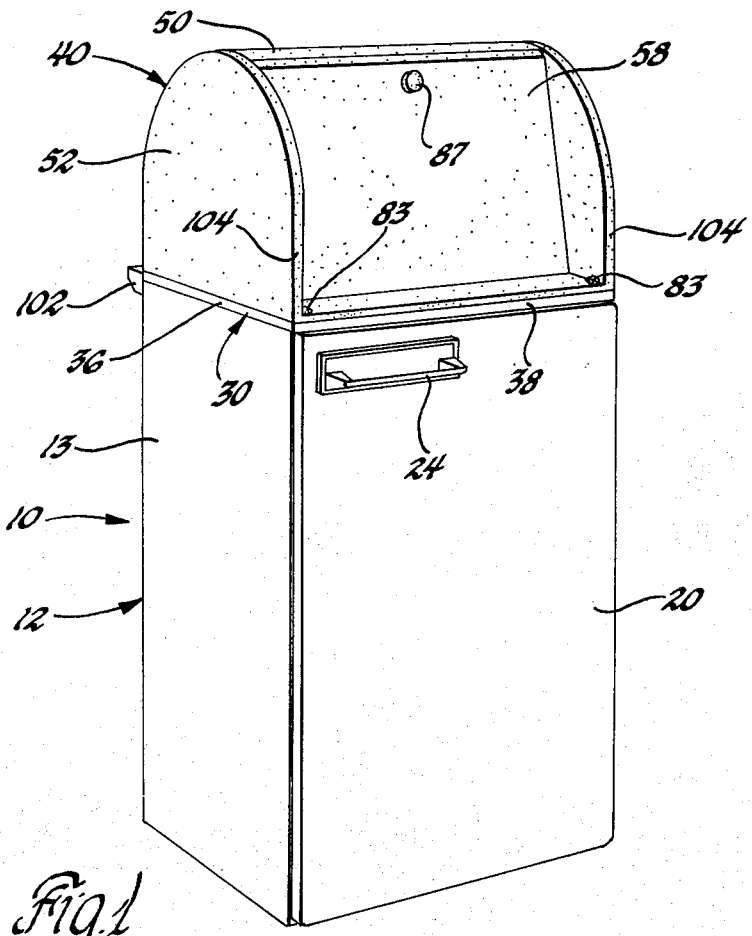
FIG. 1 is a perspective view of a composite compact refrigerator cabinet and upper storage container made in accordance with the invention.

Referring now to the drawings, there is illustrated in FIG. 1 a compact refrigerator cabinet 10 having outer shell 12 including side walls 13 and 14, a rear wall 16 providing insulated walls for a food storage chamber within the cabinet. An insulated door structure 20 normally closes an opening in the front of the cabinet 10 providing access to the food storage compartment (not shown). In the preferred form the refrigerator cabinet is of the style generally referred to as a compact or economy refrigerator of apartment house size which help conserve space and have an overall size which in the disclosed embodiment has an overall height of about 33.5 inches, a width of about 20.5 inches and an overall depth, including the condenser coil assembly 22 on the back wall 16, of about 23 inches. The cabinet includes a conventional refrigeration system such as shown, for example, in the U.S. Pat. No. 3,091,946 issued June 4, 1963 to K. Kesling and assigned to the assignee of the present application. The refrigerator door includes suitable handle means shown at 24 in FIG. 1.

Figure 2:
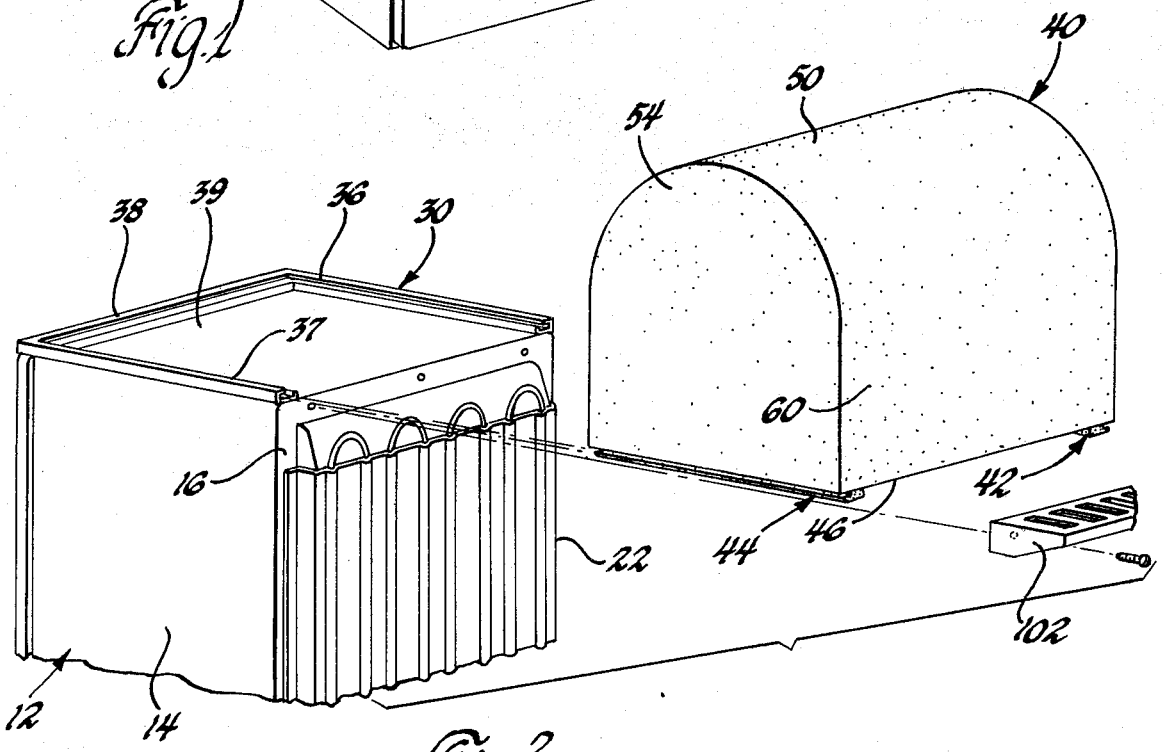
FIG. 2 is an exploded view illustrating the manner in which the top container is removably assembled to the upper wall of the refrigerator cabinet.
Figure 5:
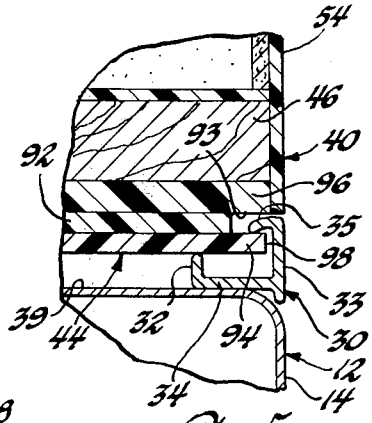
FIG. 5 is an enlarged fragmentary cross-sectional view taken on line 5—5 of FIG. 3.

In compact refrigerators a top panel (not shown) is typically provided in the form of a rectangular panel, such as a woodtone decorative panel, serving as a countertop for the unit. Such a decorative cover panel, which is substantially coextensive with the rectangular top wall of the refrigerator cabinet, is removably retained by means of a decorative top trim frame 30 having a substantially U-shape in horizontal plan (FIG. 2). As shown in FIG. 5 the frame 30 is channel-sectioned in vertical cross section with an inner short upright flange 32, an outer long upright flange 33 and a horizontal bight portion 34 with long flange 33 formed with an inwardly directed return flange 35. The longitudinally extending arm portions 36 and 37 of the U-shaped trim frame member connected by cross portion 38 define inwardly facing trackways, defined by the upper edge of short flange 32 and the underside of return flange 35, in opposed relation to provide a pair of spaced apart trackways fixed to the cabinet upper wall 39 for reception of a top container assembly, generally indicated at 40. As seen in FIG. 2 a pair of elongated brackets 42 and 44 extend longitudinally along the bottom wall or base 46 of the container top assembly 40 adjacent each side edge.

Figure 3:
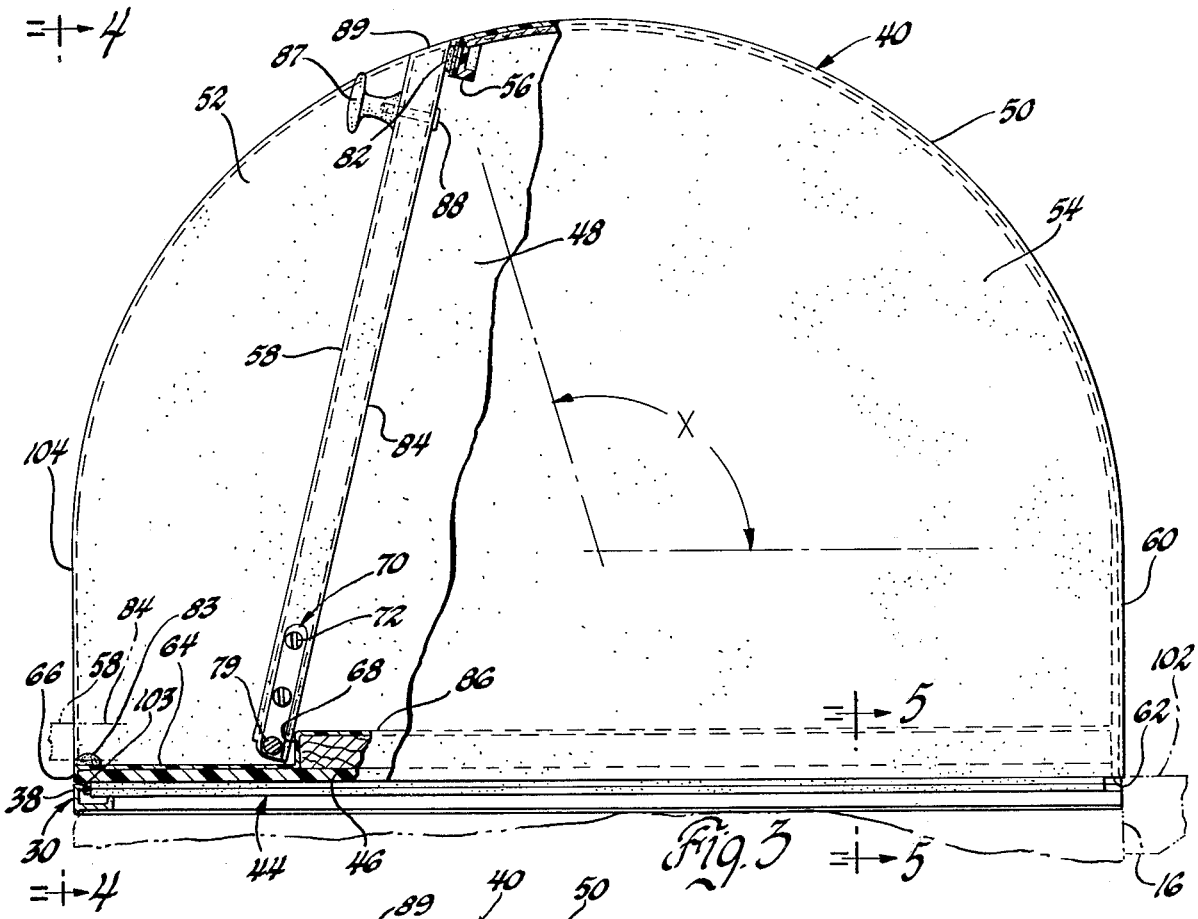
FIG. 3 is an enlarged side elevational view of the container with parts broken away, showing the closure member in its overcenter closed position with its downwardly pivoted service position being shown in dashed lines.

With reference to FIG. 3 the top container assembly 40, enclosing a storage compartment or space 48, is shown having a generally semi-cylindrical or half-round configuration including the bottom wall 46 and a concavo-convex top wall 50 which with its generally half-round side walls 52 and 54 define an access opening 56 at the front which is closed by a downwardly pivoting closure or door member 58. The removable top container 40 is a frameless container forming a modified U-section box having its top wall portion 50 of single curvature together with an upstanding rear portion 60 extending substantially tangentially from the rearward end of the curved top 50 so as to terminate at a lower edge 62 such that tangential section 60 is substantially flush with the rear wall 16 of the refrigerator cabinet when assembled therewith. As seen in FIG. 3, the container concavo-convex wall 50 extends through a predetermined arcuate angle X of about 105° in the preferred form to define the front recessed access opening 56 having a generally rectangular opening.

Figure 4:
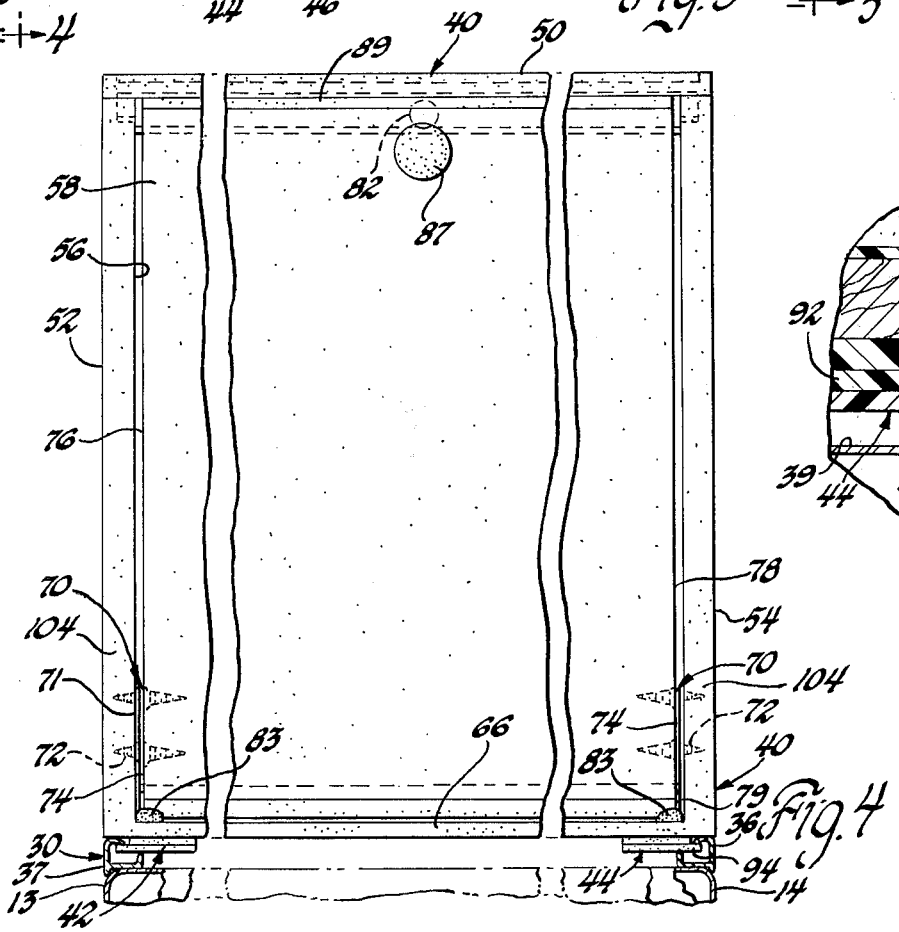
FIG. 4 is a front elevational view of the container showing details of the securing means and closure hinge means.

With reference to FIGS. 3 and 4, it will be seen that the container base 46 includes a notched recess or offset portion 64 which extends inwardly from the front edge 66 of the base a defined distance so as to form a transverse shoulder 68. In the preferred form the notch 64 has a longitudinal dimension between edge 66 and shoulder 68 substantially equal to the vertical height of rearward portion 60.

The closure or door 58 is pivotally hinged at the rear edge of notched recess 64 to normally close the access opening 56. The closure 58 is pivoted by means of link hinges 70 having an outer link 71 secured by wood screws 72 to the side walls 52 and 54 while the inner links 74 are secured to the closure edges 76 and 78 to allow the closure to move about hinge pins 79. By virtue of this construction the closure 58 may be pivoted from its closed overcenter solid line position, wherein its upper edge contacts resilient stop members 82, to its open position wherein its outer surface contacts resilient stop member 83 such that the door inner surface 84 forms a complementary flush surface with horizontal surface 86 of the container base 46. In this way a continuous work area is provided for the user for the preparation of foods and beverages or the like which may be stored in either the container 40 or the refrigerator 12. A handle 87 is secured by threaded fastener 88 adjacent the upper beveled edge 89 of the closure 58.

With reference to FIGS. 2 and 5, it will be seen that the container 40 is removably secured to the compact refrigerator top trim frame 30 by means of the elongated L-sectioned brackets 42 and 44 which are mirror images of each other. As both brackets 42, 44 are identical only the bracket 44 is shown in detail. Bracket 44 is shown in FIG. 5 having a first wing 92 suitably secured to the undersurface 93 of container base 46. The brackets' second flange wing 94 extends outwardly toward the base side edge 96 and are spaced a defined distance from the base undersurface 93 so as to be slidably receivable in the opposed trackways formed by the longitudinal leg portions 36 and 37 of the top trim frame 30. It will be noted that the outer edge 98 of wing 94 is recessed inwardly from the container base edge 96 a defined distance whereby the outer surface of large flange 33 is substantially flush with the container side wall 54 and thereby provides the appearance of the refrigerator cabinet and container 40 being a unitary structure.

Thus, for the operator to install the top container 40 on the refrigerator it is merely necessary first to remove the vent grille 102 (FIG. 1) and top panel (not shown) from the refrigerator. Then, working from the rear of the refrigerator, the operator holds the top 40 so its closure faces forwardly and aligns the flange legs 94 of the top bracket guides with the trim frame trackway or grooves and slides the container 40 forward until it is fully in place. In this regard it will be noted that the forward edge of the brackets 42 and 44 have their forward faces, as shown by face 103 of bracket 44, recessed from the front vertical edges 104 of the container side walls 52, 54 to allow the edges 104 to be positioned in substantial flush relation with the outer face of refrigerator door 20 as seen in FIG. 3. Repositioning of the vent grille 102 by securing its screws into the cabinet rear wall 16 will cause the grille 102 to secure the top container firmly in place.

While the embodiment of the present invention as herein disclosed constitutes a preferred form, it is to be understood that other forms might be adopted.

I claim:

1. A top storage container adapted to be removably retained on the top of a domestic refrigerator cabinet, said cabinet having a U-shaped trim strip positioned along the front and side edges of the refrigerator cabinet upper wall, said trim strip providing opposed trackways along the cabinet upper side edges to normally slidably receive a removed top wall panel, the improvement wherein said storage container including flange means on the underside thereof slidably received in the cabinet trackways, said container having half-round side walls joined by a concavo-convex top wall of single curvature including a lateral rear wall portion extending substantially tangentially downwardly from the rearward terminal end of said concavo-convex top wall, said container having a base wall coextensive with the cabinet upper wall, said concavo-convex top wall extending through a predetermined obtuse angle to define a front rearwardly and upwardly inclined access opening, said base wall having a transverse shoulder formed by a notched portion extending inwardly from the base wall front edge, and a door pivotally supported adjacent said shoulder whereby said door opens downwardly from an upstanding overcenter position closing said access opening to a horizontally disposed position substantially flush with the upper surface of said base wall forming an extension thereof for use as a service area or the like.

2. A top storage container adapted to be removably retained on the top of a domestic refrigerator cabinet, said cabinet having a U-shaped trim strip positioned along the front and side edges of the refrigerator cabinet upper wall, said trim strip providing opposed trackways along the cabinet upper side edges to normally slidably receive a removed top wall panel, the improvement wherein said storage container including flange means on the underside thereof slidably received in the cabinet trackways, said container having half-round side walls joined by a concavo-convex top wall of single curvature including a lateral rear wall portion extending substantially tangentially downwardly from the rearward terminal end of said concavo-convex top wall, said container having a base wall coextensive with the cabinet upper wall, said concavo-convex wall extending through a predetermined arc of about 105° to define a front access opening, said base wall having a transverse shoulder formed by a notched portion extending inwardly from the base wall front edge a distance substantially equal to the height of said lateral rear wall portion, and a door pivotally supported by link hinge means adjacent said shoulder, whereby said door opens downwardly from an upstanding overcenter position closing said access opening to a horizontally disposed position substantially flush with the upper surface of said base wall forming an extension thereof for use as a service area or the like.

3. A top storage container adapted to be removably retained on the top of a compact box-shaped refrigerator cabinet, said cabinet having a U-shaped trim strip positioned along the front and side edges of the refrigerator cabinet upper wall, said trim strip being channel-shaped in vertical section with an inner short upright flange and an outer long upright flange joined by a horizontally disposed bight portion with said long flange formed with an inwardly directed return flange, providing opposed trackways along the cabinet upper side edges to normally slidably receive a removed panel, the outer surfaces of the upright flanges being substantially flush with their adjacent cabinet side walls, the improvement wherein said storage container including flange means on the underside thereof slidably received in the cabinet trackways, said container having inverted half-round side walls joined by a concavo-convex top wall of single curvature including a lateral rear wall portion extending substantially tangentially downwardly from the rearward terminal end of said concavo-convex top wall, said container having a base wall coextensive with the cabinet upper wall, said flange means in the form of elongated L-sectioned brackets fixedly secured to the undersurface of said container base along each side edge thereof, each said bracket including a first wing secured to said base undersurface, said bracket having a second wing extending from said first wing toward the base side edge and spaced a defined distance from the undersurface thereof, said second wing outer edge being spaced inwardly from the adjacent container side wall a defined distance, whereby the outer surface of said trim long flange is substantially flush with the adjacent container side wall such that said container and refrigerator cabinet simulate a unitary structure, said concavo-convex top wall extending through a predetermined obtuse angle to define a rearwardly and upwardly inclined front access opening, said base wall having a transverse shoulder formed by a notched portion extending inwardly from the base wall front edge, and a door pivotally supported adjacent said shoulder whereby said door opens downwardly from an upstanding overcenter position closing said access opening to a horizontally disposed position substantially flush with the upper surface of said base wall forming an extension thereof for use as a service area or the like.

* * * * *

UNITED STATES PATENT OFFICE
CERTIFICATE OF CORRECTION

Patent No. 4,002,384 Dated January 11, 1977

Inventor(s) Richard C. Brown et al.

It is certified that error appears in the above-identified patent and that said Letters Patent are hereby corrected as shown below:

On the cover sheet, the illustrative drawing should appear as shown on the attached sheet.

UNITED STATES PATENT OFFICE
CERTIFICATE OF CORRECTION

Patent No. 4,002,384 Dated January 11, 1977

Inventor(s) Richard C. Brown et al.

It is certified that error appears in the above-identified patent and that said Letters Patent are hereby corrected as shown below:

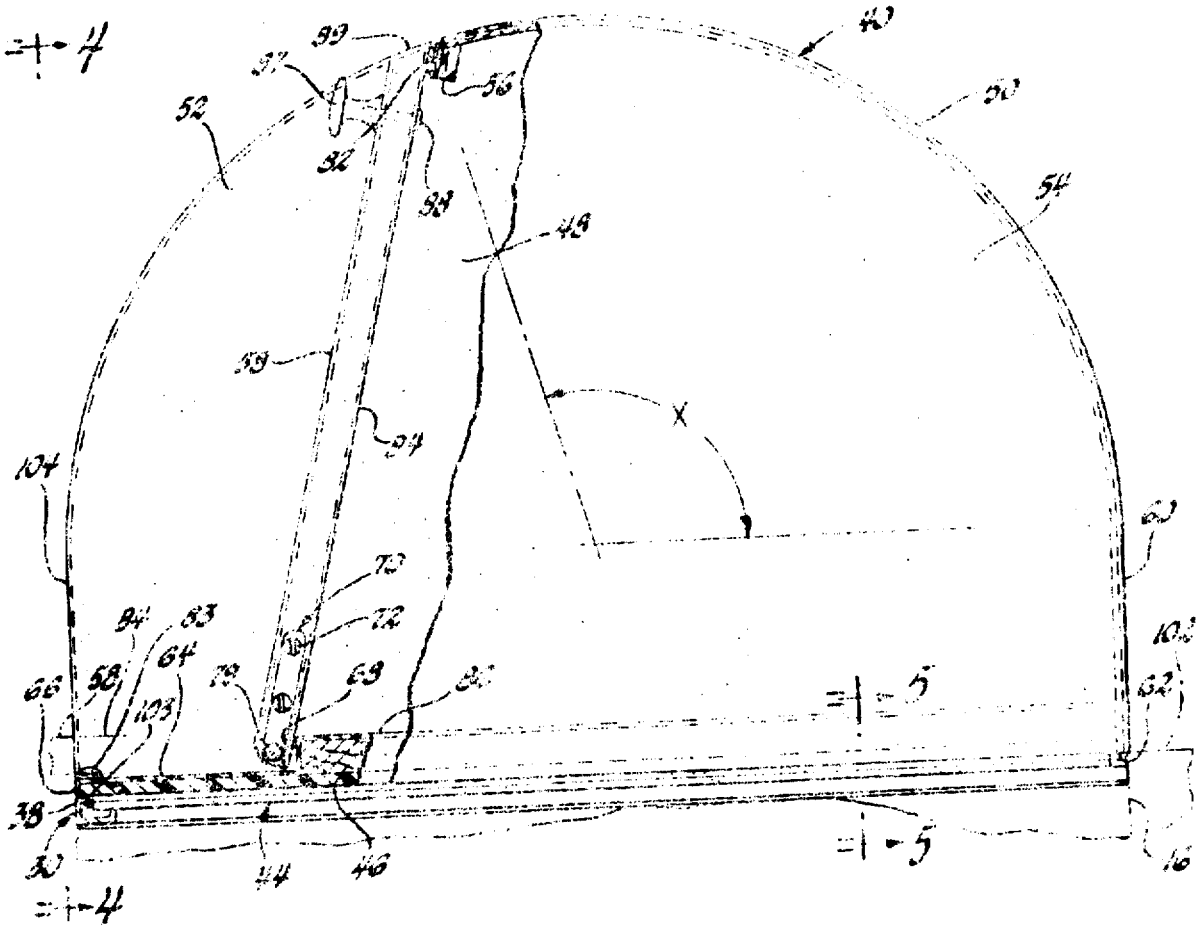

Signed and Sealed this

Nineteenth Day of April 1977

[SEAL]

*Attest:*

RUTH C. MASON
*Attesting Officer*

C. MARSHALL DANN
*Commissioner of Patents and Trademarks*